US005873205A

United States Patent [19]

Hanlon et al.

[11] Patent Number: 5,873,205

[45] Date of Patent: Feb. 23, 1999

[54] PRIVACY PANEL FOR USE WITH OPEN OFFICE FURNITURE SYSTEMS

[75] Inventors: Jerry C. Hanlon, Rescue; Everett T. Bahre, Los Altos; Terrance G. Kissinger, Belmont, all of Calif.

[73] Assignee: Advantage Office Systems, LLC, Mountain View, Calif.

[21] Appl. No.: 741,602

[22] Filed: Nov. 1, 1996

Related U.S. Application Data

[63] Continuation-in-part of Ser. No. 554,235, Nov. 8, 1995, Pat. No. 5,778,612, which is a continuation of Ser. No. 396,365, Feb. 27, 1995, abandoned, which is a continuation of Ser. No. 272,885, Jul. 7, 1994, abandoned, which is a continuation of Ser. No. 136,487, Oct. 13, 1993, abandoned, which is a continuation of Ser. No. 866,726, Apr. 10, 1992, abandoned, which is a continuation-in-part of Ser. No. 757,884, Sep. 11, 1991, Pat. No. 5,125,202, which is a continuation-in-part of Ser. No. 619,368, Nov. 28, 1990, abandoned.

[51] Int. Cl.[6] ..... E04B 2/76

[52] U.S. Cl. ..... 52/239; 52/64; 52/67; 49/404; 49/158

[58] Field of Search ..... 160/135, 351; 49/404, 158, 372; 52/239, 64, 67, 243.1, 745.15, 745.05, 745.2

[56] References Cited

U.S. PATENT DOCUMENTS

| | | | |
|---|---|---|---|
| 792,040 | 6/1905 | Hopkins . | |
| 3,420,569 | 1/1969 | Waldrop . | |
| 3,705,468 | 12/1972 | Ashworth . | |
| 4,336,670 | 6/1982 | Brutosky . | |
| 4,716,693 | 1/1988 | Webster . | |
| 4,723,374 | 2/1988 | Peterson et al. | 49/404 |
| 4,833,840 | 5/1989 | Kalischewski et al. | 52/64 |
| 4,870,908 | 10/1989 | Wolters et al. . | |
| 4,911,087 | 3/1990 | Couvrette . | |
| 4,932,177 | 6/1990 | Hinden . | |
| 5,067,287 | 11/1991 | Lewis . | |
| 5,125,202 | 6/1992 | Kissinger . | |
| 5,129,200 | 7/1992 | Kaneko . | |
| 5,136,813 | 8/1992 | Gibbs et al. . | |
| 5,219,406 | 6/1993 | Raz . | |
| 5,272,838 | 12/1993 | Gibbs . | |
| 5,277,006 | 1/1994 | Ruster . | |
| 5,282,606 | 2/1994 | Praiss | 160/135 X |
| 5,309,686 | 5/1994 | Underwood et al. . | |
| 5,313,739 | 5/1994 | Nelson et al. | 49/404 |
| 5,321,579 | 6/1994 | Brown et al. . | |
| 5,579,608 | 12/1996 | Dunn | 49/404 |
| 5,675,946 | 10/1997 | Verbeek et al. . | |

*Primary Examiner*—Christopher Kent
*Assistant Examiner*—Yvonne Horton-Richardson
*Attorney, Agent, or Firm*—Skjerven, Morrill, MacPherson, Franklin & Friel; David E. Steuber

[57] ABSTRACT

A moveable panel is described for providing privacy for a person in a work station or other location behind an arrangement of one or more stationary panels. The privacy panel is suspended from a pair of linear bearings which ride along a horizontal carrier rod mounted to the top edge of the stationary panel by a pair of hanging brackets. The linear bearings are attached to the privacy panel near its trailing edge so that the privacy panel can be moved to close an entryway adjacent the stationary panel. The entire assembly is preferably made of lightweight materials and can be easily mounted onto an existing stationary panel.

11 Claims, 7 Drawing Sheets

PRIVACY PANEL FOR USE WITH OPEN OFFICE FURNITURE SYSTEMS

This is a continuation-in-part of application Ser. No. 08/554,235, filed Nov. 8, 1995, now U.S. Pat. No. 5,778, 612, which was a continuation of application Ser. No. 08/396,365, filed Feb. 27, 1995 now abandoned, which was a continuation of application Ser. No. 08/272,885, filed Jul. 7, 1994 now abandoned, which was a continuation of application Ser. No. 08/136,487 now abandoned, filed Oct. 13, 1993, which was a continuation of application Ser. No. 07/866,726 now abandoned, filed Apr. 10, 1992, which was a continuation-in-part of application Ser. No. 07/757,884, filed Sep. 11, 1991, now U.S. Pat. No. 5,125,202, which was a continuation-in-part of application Ser. No. 07/619,368, filed Nov. 28, 1990 now abandoned.

FIELD OF THE INVENTION

This invention relates to modular office systems, and in particular to panels used to provide separate working areas for persons employed in offices, factories and other places of employment.

BACKGROUND OF THE INVENTION

Panels are widely used in commerce and industry to define separate working areas, sometimes referred to as work stations or cubicles, for workers in offices, factories and the like. Such panels have several advantages. They allow for a relatively open workplace, with free distribution of air and light over a large area, thereby avoiding the rigidly compartmentalized environment that would result from a maze of separate rooms and hallways. At the same time, they define a separate working area which each employee can call his or her own, and they provide a modicum of privacy for each employee. Most importantly, panels are relatively inexpensive to install and, being fabricated as separate units, can be readily moved from place to place as the needs of the workplace change. Typically, such panels rest on short legs or glides and range in height from 34 inches to 80 inches, with the most predominant size being approximately 60 inches.

While, as noted, panels provide a certain amount of privacy for each worker, in the past this feature has been limited by the presence of an open entryway into each work station. As a result, each worker is subject to unwanted intrusions and disturbances from other workers and has no way of clearly indicating that he or she does not wish to be disturbed. This has numerous deleterious effects on the quality of work product and environment. For example, a worker may need to concentrate on a particular task in order to complete it on time. Interruptions may break his or her "train of thought" and result in wasted time and stress. Privacy may be desirable during certain meetings or conferences, in particular those relating to performance reviews and other personnel matters. Workers in telemarketing and/or sales need uninterrupted time to communicate with company clients. Health needs may also need to be addressed; workers who are suffering from colds or other ailments may want more privacy for a duration of several days, and this coincides with the interests of other workers in minimizing the risk of contagion.

SUMMARY OF THE INVENTION

In accordance with this invention, a sliding privacy panel is movably mounted to a stationary panel on one side of an entryway to a work station. In one embodiment, the privacy panel rests in a cavity inside the stationary panel when it is not in use, the cavity being open on one lateral edge of the stationary panel. When an employee in the work station desires privacy, he or she slides the privacy panel out of the stationary panel to close off the entryway, thereby reducing interference from outside noise and indicating to other workers that he or she does not want to be disturbed. The sliding privacy panel may slide out of the mother panel on ball bearing slides. Magnets may be provided to hold the panel in an open or closed position. A foot containing a roller or skid may be provided to support the privacy panel on the floor when it is in a closed position.

A privacy panel in accordance with this invention is simple and relatively inexpensive.

In another embodiment, the top of the privacy panel slides in a channel mounted in the stationary panel and the bottom of the privacy panel glides on a series of rollers. A V-shaped structure is provided to guide the privacy panel into latching contact with the stationary panel on the opposite side of the entryway.

In yet another embodiment, a privacy panel assembly is mounted onto the outside of a existing stationary partition panel, the privacy panel being positioned adjacent a sidewall of the stationary panel when the entryway is open. The privacy panel is suspended from a linear bearing which glides along a horizontal carrier rod mounted by hanging brackets to the stationary panel, the linear bearing being attached to the privacy panel near its trailing edge. In one embodiment, the privacy panel is suspended from a pair of linear ball bearings. The entire assembly is preferably made lightweight so that it can easily be mounted onto an existing stationary panel.

DETAILED DESCRIPTION OF THE INVENTION

Figure 1:
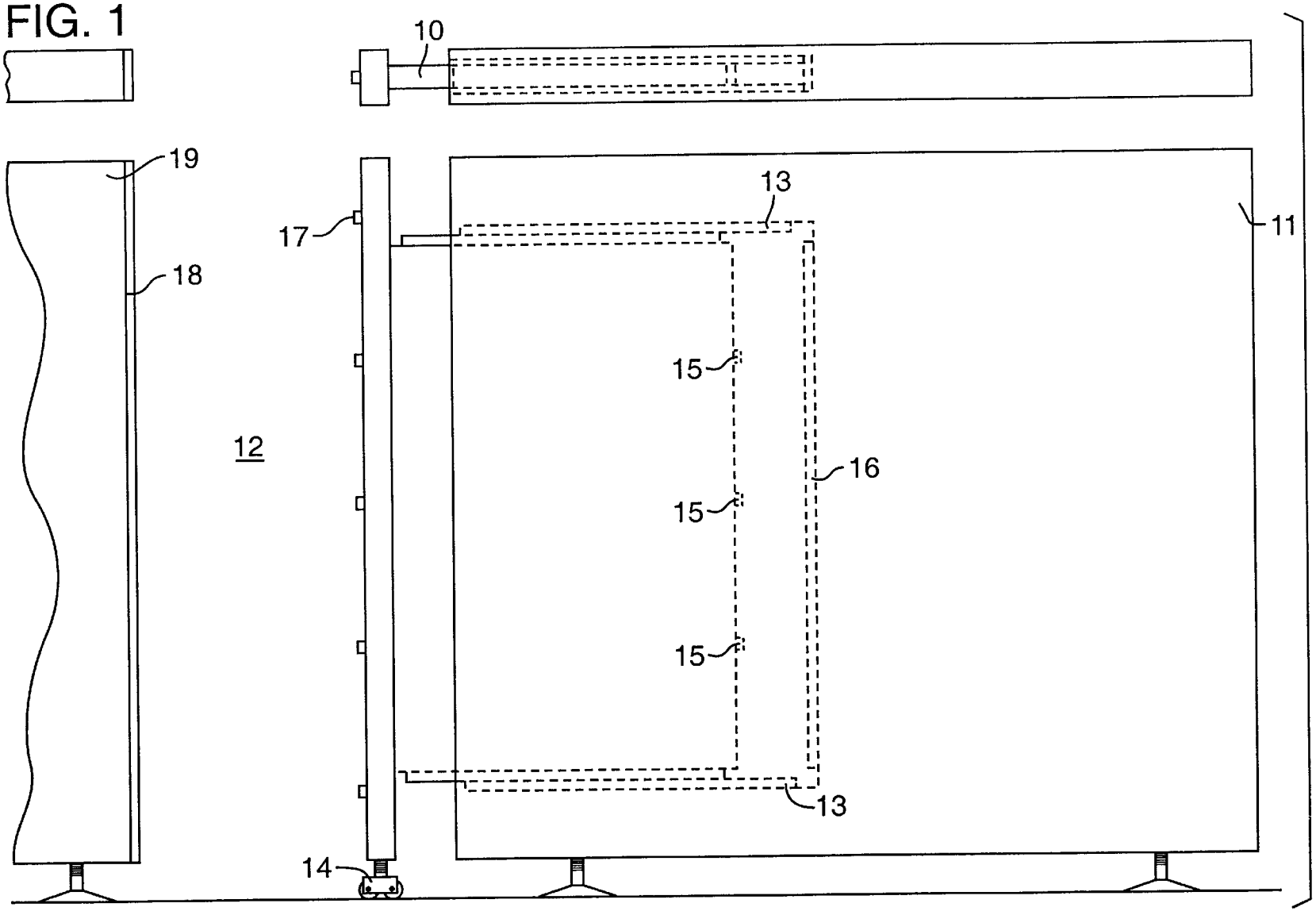
FIG. 1 shows top and side views of a privacy panel in accordance with this invention.

In FIG. 1, a privacy panel 10 is mounted within a stationary panel 11 beside an entry 12 to a work station. Privacy panel 10 is supported by a ball bearing slide 13 and by a roller foot 14, which together support panel 10 as it glides between open and closed positions. Magnets 15 make contact with a metal strip 16 to hold panel 10 in an open position, and magnets 17 contact a metal strip 18 on a stationary panel 19 across entry 12 to hold panel 10 in a closed position.

Figure 2:
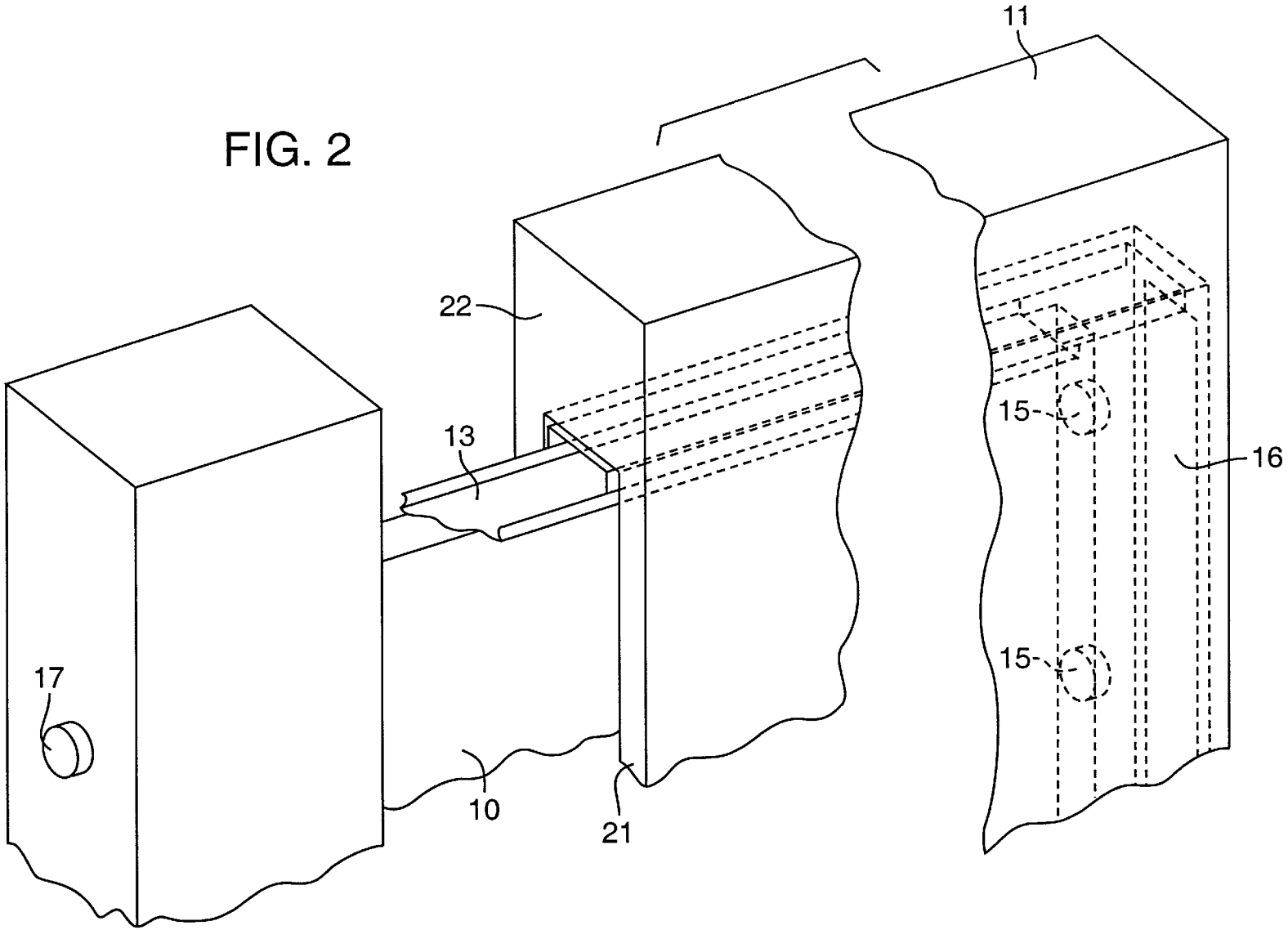
FIG. 2 is a detailed perspective view of a portion of a privacy panel in accordance with the invention.

FIG. 2 is a more detailed perspective view of a portion of privacy panel 10 and in particular shows a cavity 21 which is open on a lateral edge 22 of stationary panel 11 and within which privacy panel 10 rests when it is in a open position.

Privacy panel 10 thus answers a long unfilled need for a simple, effective and inexpensive means of providing reasonable privacy to workers and others who occupy areas that are defined by modular partitions. While a major application of this invention is in the workplace, it also is usable in health care facilities, homes and other locations where partitions are found.

It will be understood that the embodiment shown in FIGS. 1 and 2 is illustrative only, and that several of the elements shown therein are optional or can be replaced by other known elements having a similar function. For example, ball bearing slide 13 can be replaced by other known mechanisms for permitting adjacent surfaces to slide or otherwise move in a direction parallel with respect to each other. Roller foot 14 may be replaced by wheels, skids or other types of moveable supports, or it may be omitted altogether if panel 10 is given sufficient support by the members which position it within panel 11. Magnets 15 and 17 may be omitted or replaced by various types of spring-loaded or other latching or retaining mechanisms. Stationary panels 11 and 19 are typically about five feet in height, but they may be either higher or lower. Moreover, stationary panel 19 may be replaced by a wall or any other physical barrier which can define one side of an entryway. In addition to the foregoing, those skilled in the art will be able to conceive of or recognize numerous alternative embodiments all of which are within the broad scope and principles of this invention.

Figure 3:
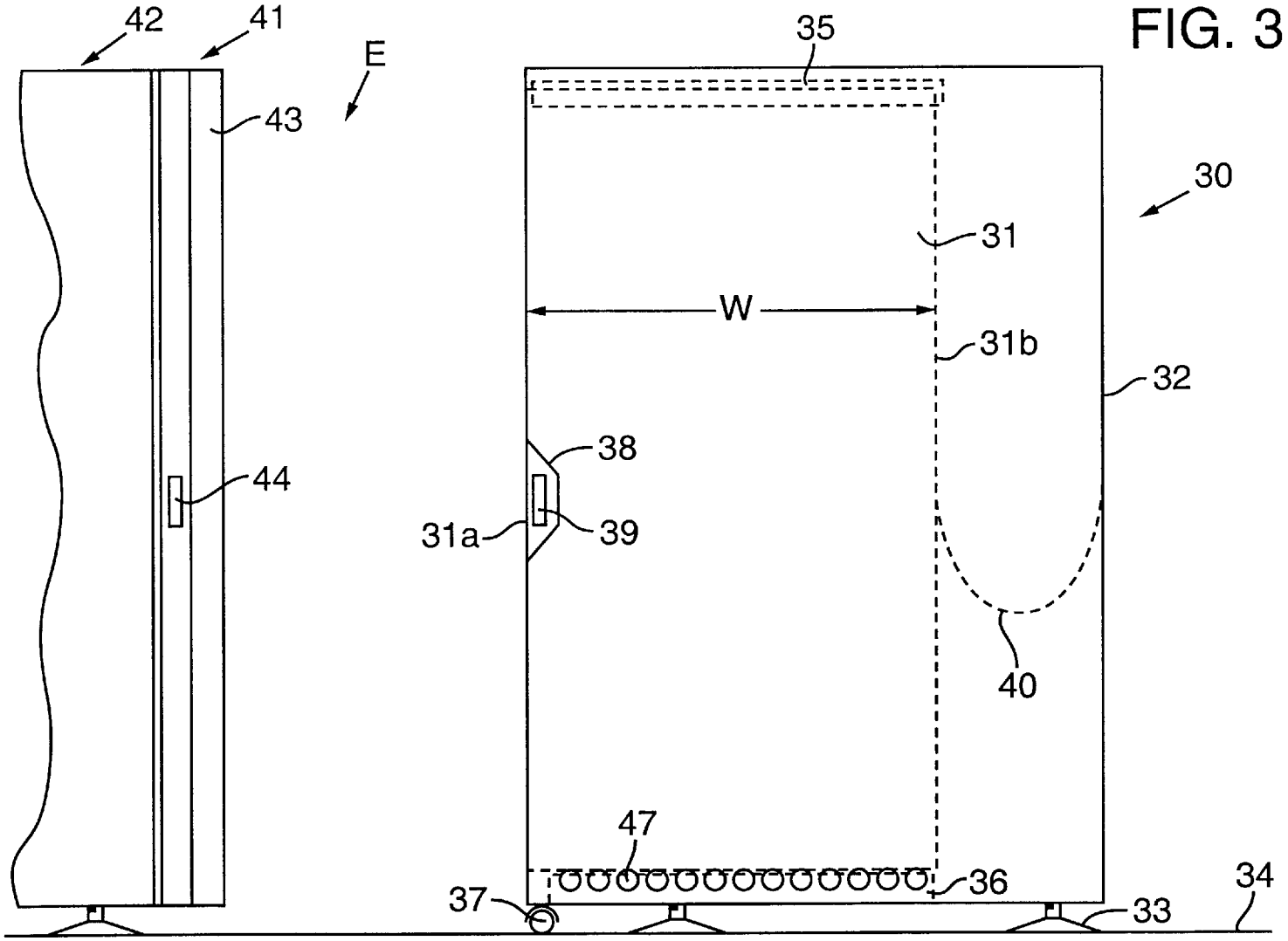
FIG. 3 is a side view of a second embodiment according to the invention.

FIG. 3 shows an alternative embodiment in accordance with the invention. A privacy panel unit 30 contains a privacy panel 31 with a leading edge 31*a* and a trailing edge 31*b*. A fixed edge 32 of privacy panel unit 30 is designed to be attached to existing stationary panels in an office work station or cubicle, for example. Privacy panel unit 30 has two legs 33, which rest on a floor 34. Floor 34 may or may not be carpeted.

The upper edge of privacy panel 31 slides in a channel 35, which is mounted near the top of privacy panel unit 30. The bottom edge of privacy panel 31 rests on a roller rail 36, which is mounted near the bottom of privacy panel unit 30. Leading edge 31*a* of privacy panel 31 is supported by a roller 37, which is similar to the casters used on office desk chairs, with the vertical supporting shaft fixed so that the caster may not swivel as panel 31 is opened and closed. Roller 37 is designed to roll on floor 34, without the need for any complementary structure (e.g., a track) to be mounted on or in the floor. Thus, since neither legs 33 nor roller 37 is attached to floor 34, privacy panel unit 30 is a portable, modular unit which may be installed and removed without any structural modifications to the building.

The side wall of privacy panel unit 30 is cut away in region 38 so as to expose a recessed handle 39 in privacy panel 31, thereby allowing the occupant of the work station or cubicle easily to grasp privacy panel 31 when it is in its fully open position. A cord 40 is attached to the trailing edge 32*b* of privacy panel 31 and to edge 32 so as to prevent privacy panel 31 from sliding completely out of privacy panel unit 30. This is particularly important during shipment of the privacy panel unit 30. At edge 32, cord 40 is inserted through a hole and knotted, thereby allowing cord 38 to be detached should privacy panel 31 need to be removed for repairs or maintenance.

On the other side of entryway E, a latch panel 41 is attached to a stationary panel 42, which is part of the existing partition structure. Latch panel 41 contains a guide 43 and latch mechanism 44, which may or may not be keyed, and which may be omitted altogether.

Figure 4:
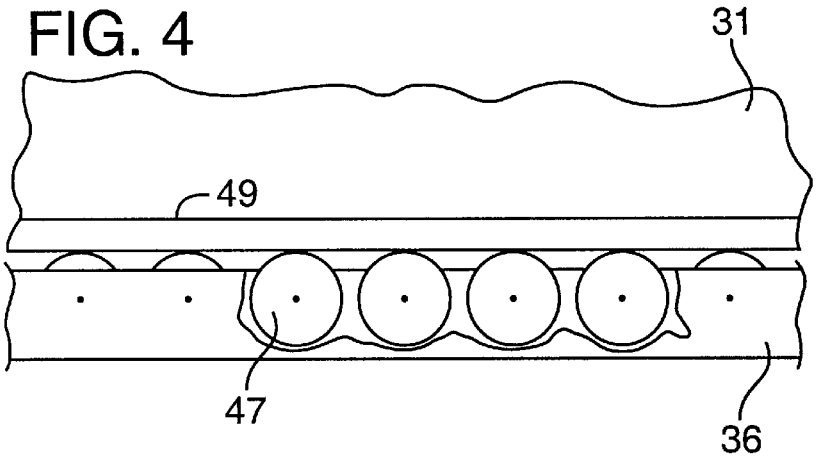
FIG. 4 is a cross-sectional view of the structures for guiding the top and bottom of the privacy panel of FIG. 3.

The details of channel 35 and roller rail 36 are shown in the cross-sectional view of FIG. 4. Channel 35 may preferably be formed of a plastic, such as high density polyethylene. Privacy panel 31 has a metal top cap 45, which slides within channel 35. It has been found that a clearance of approximately 1/16 inch between the sides of top cap 45 and the inner surfaces of channel 35 provides good stability as privacy panel 31 is withdrawn from privacy panel unit 30. Roller rail 36 comprises a metal rail 46 into which a series of plastic rollers 47 are mounted rotatably on axles 48. Privacy panel 31 has a metal bottom cap 49, which is similar to top cap 45 and rests on rollers 47. Guide bars 50 are mounted on either side of roller rail 36 to keep bottom cap 49 riding on rollers 47. A product called the Kenrail™, manufactured by Keneco, Inc. of Kenilworth, N.J., has been found suitable for use as roller rail 36. Guide bars 50 may be made from 18 gage sheet metal and riveted to the sides of the Kenrail.

Figure 5:
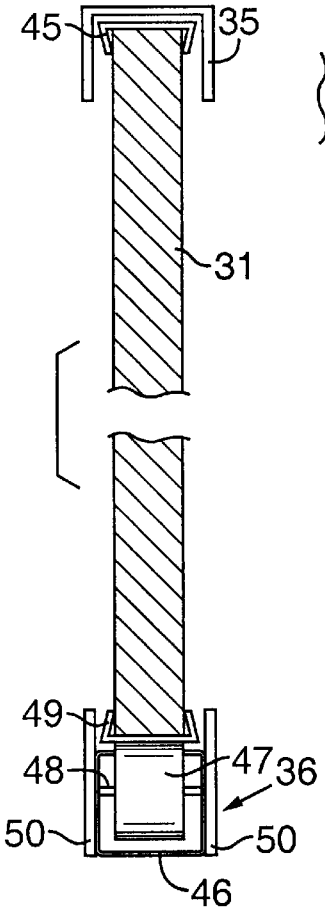
FIG. 5 is a side view of the structure for guiding the bottom of the privacy panel of FIG. 3.

FIG. 5 is a side view of roller rail 36, with guide bars 50 removed, showing in detail the manner in which bottom cap 49 rides upon roller rail 36.

Figure 6:
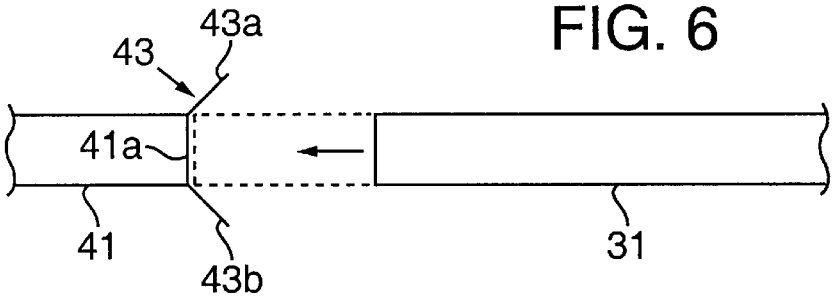
FIG. 6 is a top view of the V-shaped guide for bringing the edge of a privacy panel into contact with the stationary panel on the opposite side of the entryway.

To provide good stability, the width W of privacy panel 31 should be at least 6 inches greater than the width of entryway E. Nonetheless, as privacy panel 31 is withdrawn from unit 30, the leading edge 31*a* may tend to wander slightly as a result of the inherent play in the connections with channel 35 and roller rail 36. Accordingly, it is useful to have some means of assuring that leading edge 31*a* is properly aligned when it reaches latch panel 41 on the opposite side of the entryway. Guide 43, which is illustrated in FIG. 6, performs this function. FIG. 6 is a top view of guide 43 and shows the manner in which privacy panel is guided into proper alignment as it approaches latch panel 41. Guide 43 has two outwardly extending flanges 43*a* and 43*b* shaped generally in the form of a "V", which engage panel 31 and guide it into proper alignment with a jamb 41*a* of latch panel 41, should it get slightly out of line. Thus, privacy panel 31 makes proper contact with jamb 41*a*, and the user need not be concerned about adjusting the position of privacy panel 31 in order to get secure closure or to operate latching mechanism 44. Latching mechanism 44 may be a Model 5017 Deadlock, manufactured by Adams Rite Manufacturing Co. of California, although any type of latch which provides a firm linkage between privacy panel 31 and latch panel 41 can be used. Latch mechanism 44 may or may not be keyed, as the application dictates.

Privacy panel unit 30 and latch panel 41 are modular units which may easily be conjoined with partition panels in an existing open office arrangement.

Figure 8:
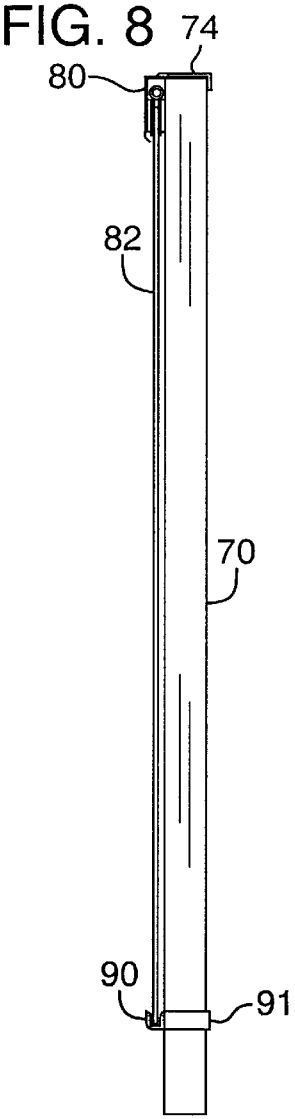
FIG. 8 is an end view of the third embodiment.
Figure 7:
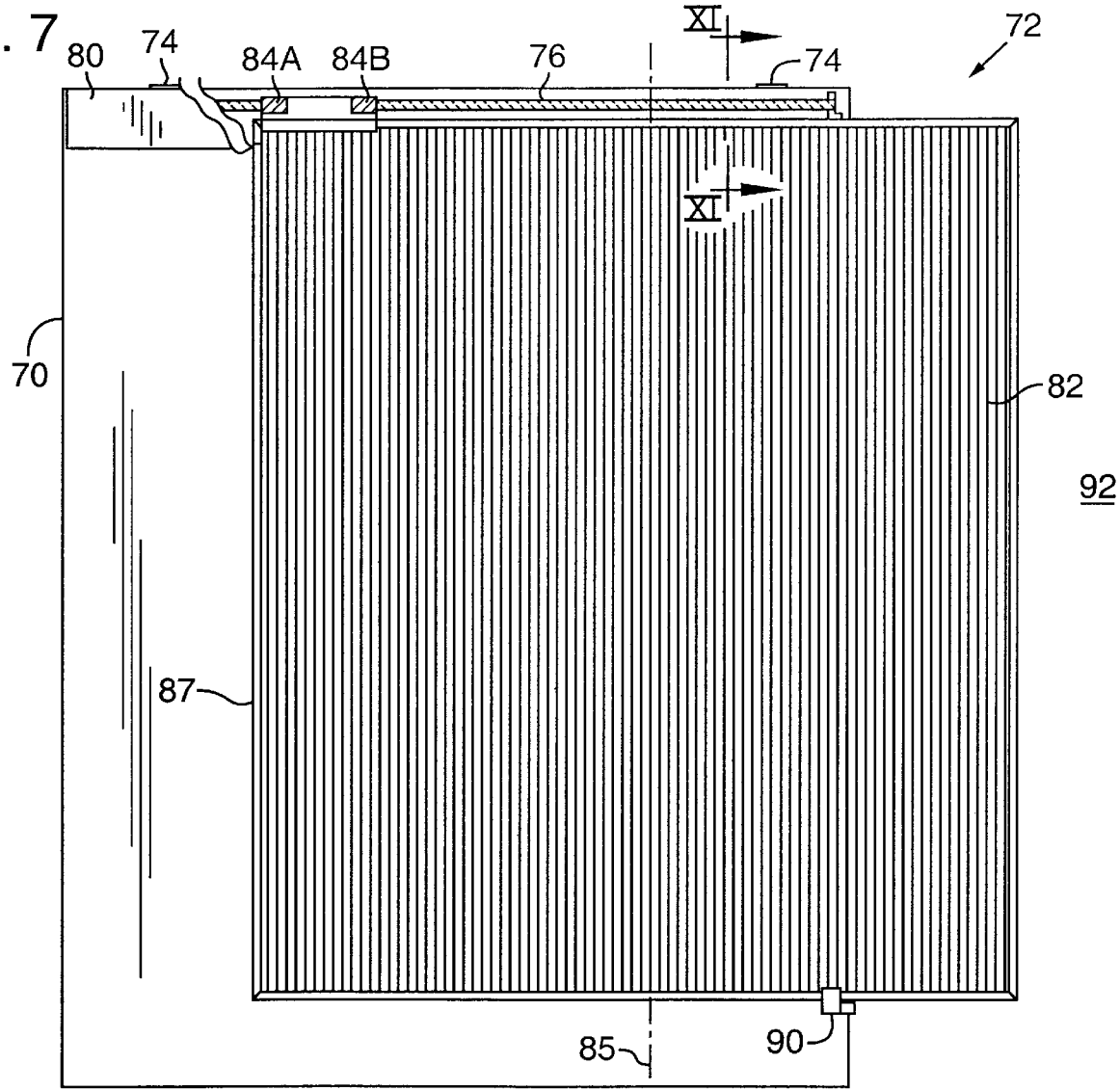
FIG. 7 is a side view of a third embodiment according to the invention, wherein a privacy panel is suspended from a carrier rod by a pair of linear bearings.

Yet another embodiment in accordance with this invention is shown in FIGS. 7–11. FIG. 7 is a side view and FIG. 8 is an end view of a stationary partition panel 70, with a privacy panel assembly 72 suspended by a pair of hanger brackets 74 which fit over a top edge of stationary panel 70. Stationary partition panel 70 typically rests on a floor and may be provided with supporting legs (not shown). Hanger brackets 74 are equipped with set screws (not shown) for securing the assembly 72 to the partition panel 70.

Figure 9:
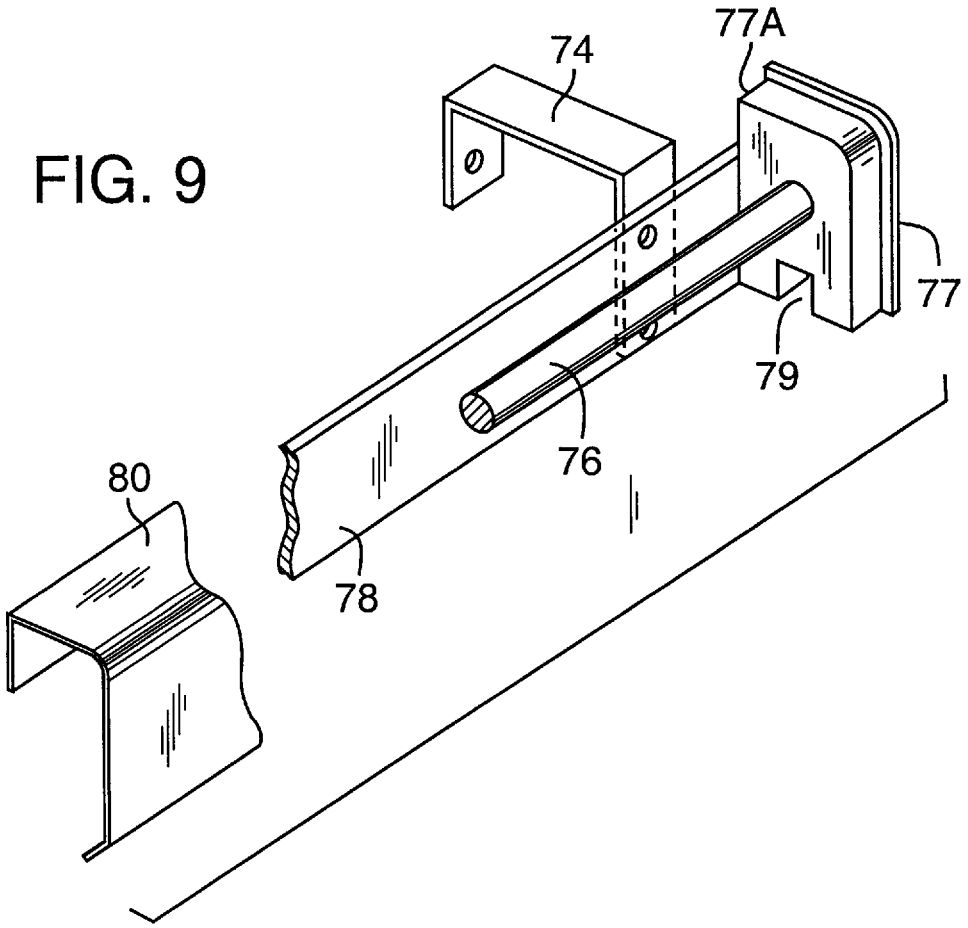
FIG. 9 is a detailed view of the structure for supporting the carrier rod in the third embodiment.
Figure 11:
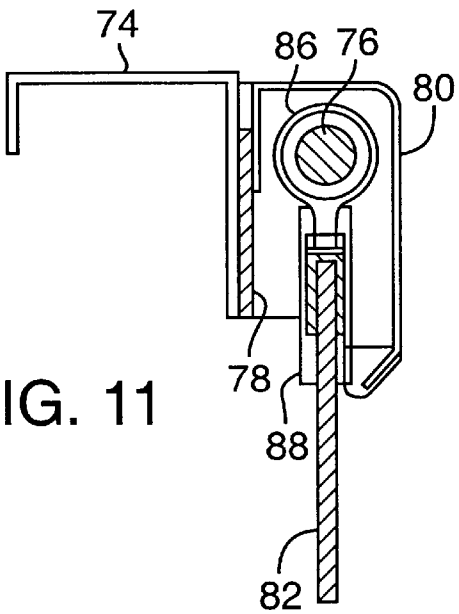
FIG. 11 is a detailed end view of the linear bearing housing and carrier rod in the third embodiment.

FIG. 9 is a detailed perspective view of the right end of assembly 72, showing how a hardened steel carrier rod 76 is positioned horizontally and to the side of the top edge of partition panel 70, as shown in FIGS. 7 and 8. Hanger brackets 74 are attached by screws to a carrier support plate 78. A series of holes (not shown) are provided on carrier support plate 78, so that hanger brackets 74 can be located at various lateral positions on the top edge of partition panel 70. Attached to an end of support plate 78 is an end bracket 77, and carrier rod 76 is fitted into a hole formed in end bracket 77. A cover 80 (broken away in FIGS. 7 and 9) fits into a recessed portion 77A of end bracket 77 and conceals carrier rod 76. The relationship of hanger bracket 74, carrier support plate 78 and cover 80 are also shown in FIG. 11, which is a cross-sectional view taken at section XI—XI shown in FIG. 7.

The left end of carrier support rod 76 is supported by a similar structure at the left side of partition panel 70. While two hanger brackets 74 are shown in FIG. 7, other embodiments may have three or more hanger brackets.

Figure 10:
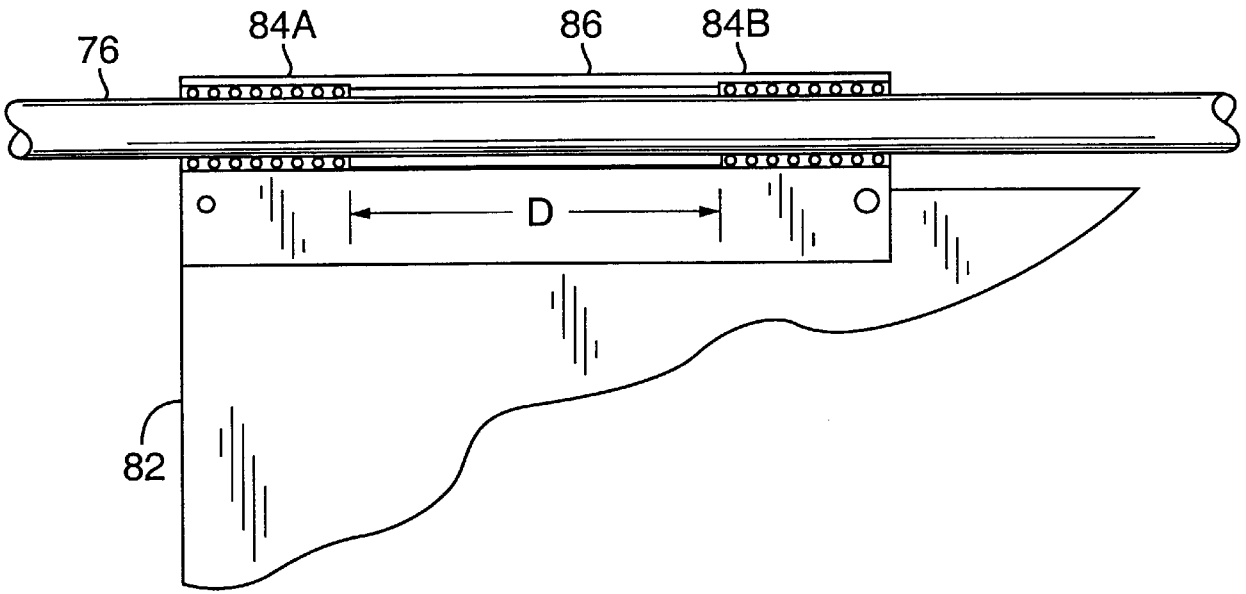
FIG. 10 is a detailed side view of the linear bearing housing and carrier rod in the third embodiment.

As shown in the close-up front view of FIG. 10, a privacy panel 82 is suspended from carrier rod 76 by means of a pair of linear ball bearings 84A and 84B, which are enclosed in a bearing housing 86. In this embodiment, bearings 84A and 84B are recirculating, endless track ball bearings such as the model Super-10 linear bearing available from Thomson Industries Inc. of Port Washington, N.Y. As shown in FIG. 11, bearing housing 86 is attached to the top of privacy panel 82 via a pair of side plates 88. A lower guide 90 is attached by a bracket 91 to the edge of partition panel 70 and contains a slot which stabilizes the bottom edge of privacy panel 82 as privacy panel 82 glides laterally along carrier rod 76. A corresponding guide slot 79 formed on a bottom edge of end bracket 77 (see FIG. 9) serves as a guide for the top edge of privacy panel 82. End bracket 77 and the similar end bracket at the left end of assembly 72 serve as stops for linear bearings 84A and 84B as they glide along carrier rod 76.

In the embodiment of FIGS. 7–11, privacy panel 82 is a THERMOCLEAR panel, made of LEXAN plastic, which is manufactured by General Electric. The THERMOCLEAR panel weighs on the order of 0.3 lb. per square foot. Thus a 48" wide×50" high panel weighs only about 5 lbs. Other types of panels made of such materials as plastic or wood could be used in place of the THERMOCLEAR panel.

Linear bearings 84A and 84B are mounted between the horizontal midpoint 85 and trailing edge 87 of privacy panel 82 and, more particularly, in the embodiment shown in FIG. 7, near an upper corner of privacy panel 82 adjacent trailing edge 87 such that privacy panel 82 is cantilevered from linear bearings 84A and 84B toward the entryway 92. In one embodiment, linear bearings 84A and 84B, separated by a distance D (FIG. 10) of only 5.1 inches, are able to support a 6–7 lb. privacy panel 82 without binding or freezing as they travel along the carrier rod 76. As is apparent from FIG. 10, privacy panel 82 imposes an upward force on bearing 84A and a downward force on bearing 84B. Because the moment or load exerted on bearings 84A and 84B is constant throughout the travel of privacy panel 82, the frictional resistance to the movement of panel 82 also remains constant in any position. Moreover, properly selected linear bearings provide privacy panel 82 with excellent lateral support against rocking or swinging in a plane parallel to partition panel 70.

In some embodiments a single linear bearing can be substituted for the pair of linear bearings 84A and 84B. Also, other types of linear bearings such as linear roller bearings, linear tapered roller bearings, and bushing-type linear bearings (having bushings made of TEFLON, ceramic, anodized aluminum or bronze) may be used in place of linear ball bearings.

Privacy panel 82 is typically positioned on the outside of the office cubicle or other area to be protected. Entryway 92 is closed by advancing privacy panel 82 until it overlaps the stationary panel on the opposite side of entryway 92 (not shown) by an amount of, for example, 1½ inches. The leading edge of privacy panel 82 may have a grip to assist the user in opening and closing the opening. The horizontal dimension of privacy panel 82 can be adapted to fit standard entryways of 31", 34", 36", etc.

The advantages of the arrangement shown in FIGS. 7–11 are numerous. The linear bearings 84A and 84B provide very little frictional resistance to the movement of panel 82 and provide excellent wear for a long product life. Guided by slot 79 and slotted guide 91, panel 82 travels in a straight line with virtually no deflection as it is opened and closed. The entire privacy panel assembly 72 can be made very light (e.g., 12 lbs) and is easily installed on a stationary panel in 3–5 minutes or less by non-expert employees. In contrast to the arrangement described in U.S. Pat. No. 3,705,468, no telescoping mechanisms or other unsightly hardware project into the entryway as the privacy panel is opened and closed. In fact, only the panel itself projects into the entryway. If a translucent material (such as LEXAN plastic) is used for the privacy panel, light is admitted to the protected area even when the privacy panel is closed, and the color and decor of the stationary panel are visible through the privacy panel when it is open, thus maintaining the continuity of the open office system.

The embodiments described above are illustrative only, and are not intended to be limiting. Many modifications of these embodiments and other embodiments in accordance with the invention will be apparent to those skilled in the art, all of which are intended to be included within the broad principles of this invention.

We claim:

1. A privacy panel arrangement for use with a stationary partition panel, said privacy panel arrangement comprising:

a plurality of hanger brackets adapted to fit over an upper edge of said stationary partition panel;

a longitudinal carrier member attached to said hanger brackets;

a linear bearing member mounted on said carrier member such that said linear bearing member can move linearly along said carrier member;

a privacy panel, said linear bearing member being attached to said privacy panel at a position near an upper edge of said privacy panel such that all components of said linear bearing member which make bearing contact with said carrier member are positioned laterally between a horizontal midpoint of said privacy panel and a trailing edge of said privacy panel, said panel thereby being cantilevered from said linear bearing member in a direction of a leading edge of said panel.

2. The privacy panel arrangement of claim 1 wherein said linear bearing member comprises a pair of linear bearings, said pair of linear bearings being mounted on said carrier member.

3. The privacy panel arrangement of claim 1 further comprising a guide for stabilizing an upper edge of said privacy panel as said linear bearing member moves along said carrier member.

4. The privacy panel arrangement of claim 1 wherein said linear bearing member is attached to said privacy panel adjacent a trailing edge of said privacy panel.

5. The privacy panel arrangement of claim 1 wherein said components of said linear bearing comprise balls.

6. The privacy panel arrangement of claim 1 wherein said carrier member comprises a rod.

7. A combination comprising:

a stationary partition panel positioned adjacent an entryway to a workstation;

a stationary carrier member fixed to said stationary partition panel parallel to an upper edge of said stationary partition panel;

a privacy panel movably positioned adjacent a sidewall of said stationary partition panel;

a linear bearing member, said privacy panel being suspended from said stationary carrier member by means of said linear bearing member, said linear bearing member comprising a bearing housing fixed to said privacy panel and a plurality of rolling members, said rolling members being in contact with both said bearing housing and said stationary carrier member and being rotatable so as to form a movable link between said bearing housing and said stationary carrier member.

8. The combination of claim 7 wherein said privacy panel is attached to said linear bearing member at a location between a horizontal midpoint and a trailing edge of said privacy panel.

9. The combination of claim 7 further comprising a guide mounted on said stationary panel for stabilizing a lower edge of said privacy panel as said linear bearing member moves along said stationary carrier member.

10. The combination of claim 7 further comprising a guide for stabilizing an upper edge of said privacy panel as said linear bearing member moves along said stationary carrier member.

11. The combination of claim 6 further comprising a second stationary panel disposed on an opposite side of said entryway, said combination being structured such that said privacy panel is capable of being moved to a position wherein a leading edge of said privacy panel is adjacent said second stationary panel so as to close said entryway, no portion of said linear bearing member extending into said entryway when said entryway is so closed.

* * * * *